US006289658B1

(12) United States Patent
Sting et al.

(10) Patent No.: US 6,289,658 B1
(45) Date of Patent: Sep. 18, 2001

(54) HANDLING UNIT, ESPECIALLY INSERTER

(75) Inventors: Martin Sting, Frankfurt; Axel Brauneis, Munzenberg/Gambach, both of (DE)

(73) Assignee: Bell & Howell GmbH, Friedberg (DE)

( * ) Notice: Subject to any disclaimer, the term of this patent is extended or adjusted under 35 U.S.C. 154(b) by 0 days.

(21) Appl. No.: 09/424,184

(22) PCT Filed: Jul. 6, 1998

(86) PCT No.: PCT/EP98/04165

§ 371 Date: Nov. 19, 1999

§ 102(e) Date: Nov. 19, 1999

(87) PCT Pub. No.: WO99/01295

PCT Pub. Date: Jan. 14, 1999

(30) Foreign Application Priority Data

Jul. 4, 1997 (DE) ..... 197 28 672

(51) Int. Cl.[7] ..... B65B 5/04; B65B 25/14
(52) U.S. Cl. ..... 53/569; 53/252; 53/284.3
(58) Field of Search ..... 53/258, 252, 569, 53/284.3

(56) References Cited

U.S. PATENT DOCUMENTS 2,325,455 * 7/1943 Williams ..... 53/284.3
4,079,576 * 3/1978 Morrison et al. ..... 53/569
4,720,960 * 1/1988 Green ..... 53/284.3
5,284,004 * 2/1994 Metzler ..... 53/569
5,457,935 * 10/1995 Kope ..... 53/252

FOREIGN PATENT DOCUMENTS 1531929 12/1967 (DE) .
2617189 4/1976 (DE) .
19500746 A1 1/1995 (DE) .

OTHER PUBLICATIONS

Kurt Hain, "Angewandte Getriebelehre," 2nd ed., p. 260–264 (1961). No Translation.

* cited by examiner

*Primary Examiner*—John Sipos
(74) *Attorney, Agent, or Firm*—Jenkins & Wilson, P.A.

(57) ABSTRACT

The invention proposes a handling apparatus for moving sheet-like articles, in particular an inserter for pushing inserts into envelopes, in which apparatus a link hand, which forms part of a rectilinear-guidance mechanism formed from three links, has spring-loaded fingers which are articulated at the free end of the link hand and slide over a base plate during the operating stroke, while, during a return stroke, the fingers are raised off together from the base plate by means of a control guide arrangement. Said apparatus operates at high cycle speeds without disruption and requires the arrangement as a whole to be of just a small overall height.

7 Claims, 3 Drawing Sheets

HANDLING UNIT, ESPECIALLY INSERTER

TECHNICAL FIELD

The invention relates to a handling station for moving sheet-like conveyable articles on a rectilinear, defined handling path, in particular an inserter for pushing inserts into envelopes.

BACKGROUND ART

Handling stations of this type are known, for example, from DE-A 41 16 708. They contain a lever arrangement or link-arm arrangement which is framework-mounted above a horizontal base plate and is in the form of a drive lever which can be pivoted by a drive apparatus for producing pivot movements of the bottom part of the drive lever substantially in the direction of the push-in movement. Arranged on the bottom part of the drive lever are pivotable fingers which are prestressed downwards by spring means and of which the outer ends rest on the base plate, and are pushed forwards thereon during an operating stroke and, during a return stroke, are raised off together from the base plate by means of a control guide arrangement.

In order, then, that the pivotable fingers, articulated at the drive-lever end, reliably rest on the base plate, or in grooves provided therein, even at high cycle speeds of the inserter, and in order to avoid the situation where the outer finger ends, which are to be positioned on the trailing edge of the inserts for the envelopes, do not miss said trailing edge of the conveyable articles, attempts have been made to move the point at which the fingers of the inserter are articulated on the link-arm arrangement, that is to say at the bottom end of the drive lever in the case of the apparatus according to DE-A41 16 708, approximately horizontally over the base plate in as uniform a manner as possible, for which reason the length of the drive lever of the known apparatus from the framework-mounted point of articulation above the base plate to the point of articulation for the fingers is selected to be as large as possible, in order that, when the drive lever pivots, the bottom drive-lever end describes the largest possible, virtually rectilinear arc of a circle. In known apparatuses of this type, this requires the apparatus as a whole to be of a comparatively large overall height.

Attempts have been made to reduce the overall height of a handling station or of an inserter of the type described in general terms above by using a linear drive mechanism for the movement of the pivot mounting of the fingers over the base plate. Designs of this type do advantageously result in a reduction in the overall height of the apparatus, but they render a handling station or an inserter quite considerably more expensive, in particular when high cycle speeds are desired.

DISCLOSURE OF THE INVENTION

The invention is to achieve the object of configuring a handling station or an inserter of the type defined in general terms in the introduction such that, along with a comparatively simple and cost-saving construction, the overall height is reduced and a high level of reliability is achieved in terms of the movement of the fingers conveying the articles which are to be handled.

This object is achieved according to the invention by the features specified in claim 1.

Advantageous configurations and embodiments form the subject matter of the patent claims which are subordinate to claim 1, but it should be noted here that the subject matters of claims 4 to 6 are of importance independently of the features of the preceding claims.

BRIEF DESCRIPTION OF THE DRAWINGS

Some of the objects of the invention have been stated hereinabove, other objects will become evident as the description proceeds, when taken in connection with the accompanying drawings as best described hereinbelow.

A preferred exemplary embodiment is explained in more detail hereinbelow with reference to the drawing, in which.

DETAILED DESCRIPTION OF THE INVENTION

Figure 1:
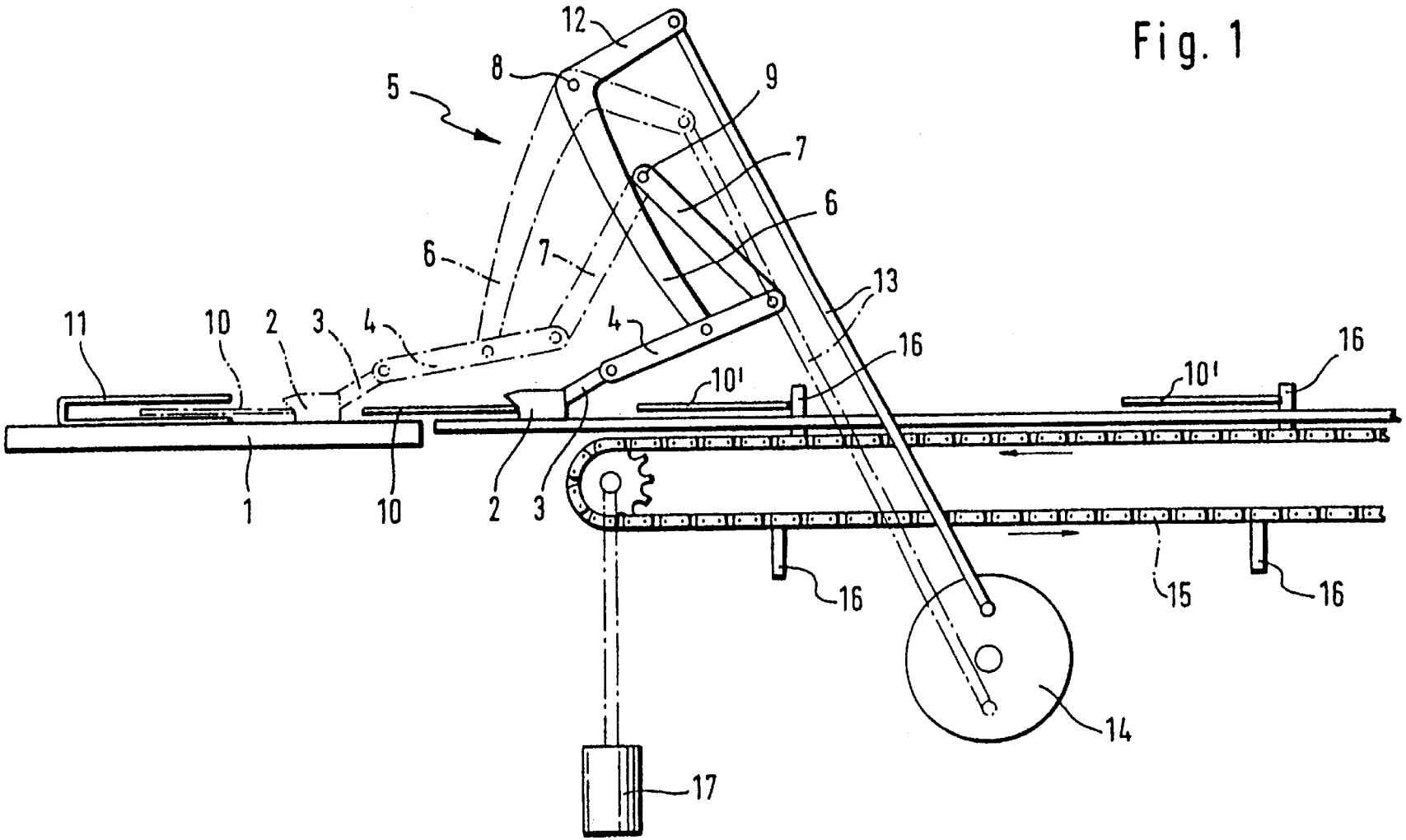
FIG. 1 shows a schematic, vastly simplified side view of a handling station or of an inserter of the type specified here.

FIG. 1 shows a side view of a base plate 1, on the top side of which push-in fingers 2 can be pushed horizontally in a direction parallel to the plane of the drawing. The push-in fingers 2 are articulated in a pivotable manner, via finger extensions 3, on part of a link arrangement 5, said part of the link arrangement being referred to hereinbelow as link hand 4, and said link arrangement, in addition to the link hand 4, contains two link arms 6 and 7 which are connected to said link hand and are of different lengths.

The respectively top ends of the links 6 and 7 are, as indicated in FIG. 1, framework-mounted above the base plate 1, while the bottom ends of the link arms 6 and 7 are connected in an articulated manner, at a certain spacing from one another, to the link hand 4, so that the free, projecting end of the link hand 4 is positioned to the side of the articulation connection point of the longer link arm 6. At said free end of the link hand 4, the finger extensions 3 of the push-in fingers 2 are connected in an articulated manner and are prestressed downwards, in the direction of the surface of the base plate 1, within a certain pivot region by spring means, which are not shown in FIGS. 1 and 2.

The framework-mounted pivot bearings for the link arms 6 and 7 are defined by 8 and 9, respectively, in the drawing.

If, in relation to FIG. 1 and to the depicted orientation of the parts, suitable conveying means convey inserts onto the base plate 1 parallel to the surface of the base plate 1 (onto the plane of the drawing, as seen in the viewing direction of the person looking at the drawing), then these inserts, of which one is indicated at 10, are pushed into an envelope, indicated at 11 in FIG. 1, from right to left, in relation to FIG. 1, by a forward movement of the push-in fingers 2, for which purpose the push-in fingers 2 engage the right-hand edge of the insert 10 and displace the insert 10 into the envelope 11 from right to left.

In order to carry out this displacement movement of the push-in fingers 2 via the push-in-finger extensions 3, the longer link arm 6 of the two pivot arms is pivoted in the clockwise direction, in the case of the embodiment according to FIG. 1, for which purpose the link arm 6 has positioned on it, in the vicinity of its point of articulation 8, an angle lug 12 which is connected to a crank drive 14 via a coupling rod 13. The crank 14 is driven in synchronism with the operating cycle of the handling station or the inserter and, if the latter is constituent part of a mail-processing machine, in synchronism with the operating cycle of the installation as a whole.

It is of considerable importance for the functioning and the particular properties of the link arrangement, constructed from the two link arms 6 and 7 and the link hand 4, that the lengths of the link arms between their framework-mounted points of articulation 8 and 9, on the one hand, and their respective points of articulation on the link hand 4, on the other hand, as well as the spacings between the points at which the link arms are articulated on the link hand 4 are selected such that the pivot movements of the link arms 6 and 7, under the action of the drive connection formed from the crank 14, the connecting rod 13 and the angle leg 12, result in the point at which the push-in fingers 2 are articulated at the projecting end of the link hand 4 moving approximately parallel over the surface of the base plate 1.

Furthermore, it is ensured that during a certain part of the operating stroke of the handling station or of the inserter, namely near the point at which the operating stroke changes over into the return stroke, the link hand 4 is moved horizontally over the base plate approximately parallel to itself. The two movement characteristics of the link hand 4, which are achieved on account of the particular coupling of said link hand to the framework-mounted mounting points 8 and 9 via the link arms 6 and 7 of different lengths, result in the push-in fingers 2 being moved in an essentially smooth and stable manner over the base plate or over grooves provided therein.

The, at least substantially, horizontal guidance of the points of articulation of the push-in fingers 2 by means of a link arrangement 5, which merely has pivot bearings, results in a simple construction which is not very susceptible to disruption and is also suitable for high operating speeds.

Instead of the abovementioned feeding of inserts 10 onto the base plate 1 in the viewing direction of the person looking at FIG. 1, or in addition to such insert feeding, there may be feeding of inserts 10' by means of a cyclically or continuously driven conveying apparatus in the form of a conveying belt or of a conveying chain 15, of which the conveying direction on the upper reach corresponds to the direction of the operating stroke of the handling station or of the inserter. Conveying fingers 16 of the conveying chain or of the conveying belt push the inserts 10' in front of them on the upper reach, the movement path of the conveying fingers 16, in positional terms, extending, transversely to the conveying direction, alongside the movement path of the push-in fingers 2 and parallel to the movement path of the latter such that, during the operating stroke and during the return stroke, the push-in fingers 2 can be guided past the cyclically or continuously advancing conveying fingers 16.

If the push-in fingers 2 have pushed an insert 10 into an envelope 11, then, in the return-stroke movement, they can quickly be moved behind a momentary position of one of the conveying fingers 16 and then, on account of appropriate coordination of the drive speeds of the crank 14, on the one hand, and of a drive 17 for the conveying belt or the conveying chain 15, on the other hand, execute, in the operating stroke, a movement which is quicker than the advancement of the conveying fingers 16. By way of the push-in fingers 2, an insert 10', then, is thus raised off from the associated conveying finger 16, pushed over the base plate 1 and introduced into the envelope 11. In the meantime, the conveying finger 16 which remains behind moves onto the lower reach of the conveying belt or the conveying chain via corresponding cutouts in a cover panel of the conveying belt or the conveying chain and a cutout of the base plate 1.

Figure 2:
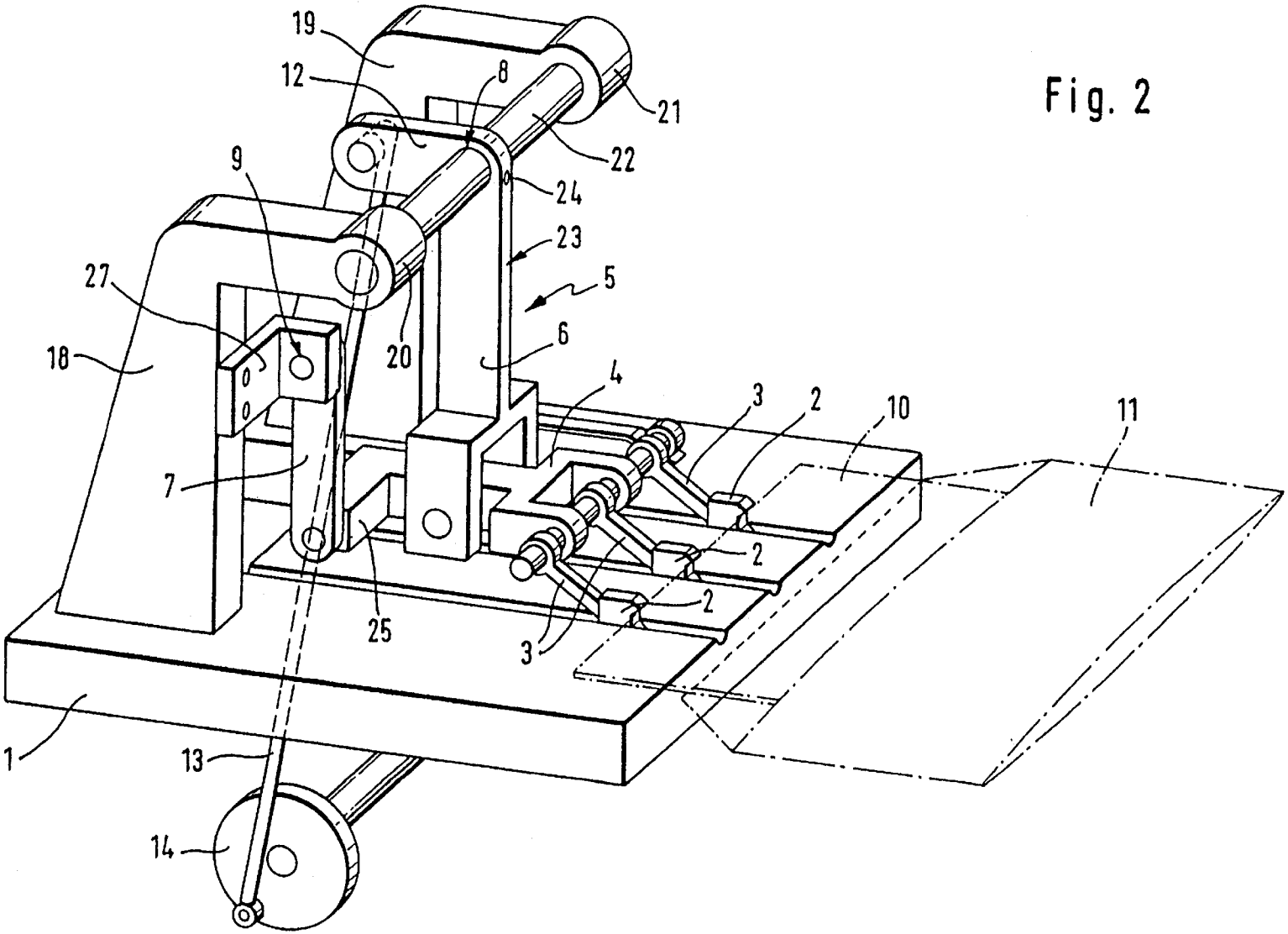
FIG. 2 shows a schematic, perspective illustration of an inserter with the essential features of a practical design.

Details of the handling station or inserter which have been described up to this point with reference to FIG. 1 can be seen from FIG. 2, the same reference numerals as in FIG. 1 being used for corresponding parts in FIG. 2.

In order to allow the largest possible pivot region of the link arms 6 and 7, the respective points of articulation on the moving parts and the connection between the mounting and the framework are formed such that the link arms can be guided past one another at least in part.

Connected fixedly to the base plate 1, or a framework part fastened thereon, are two side bearing supports 18 and 19, which are provided with bearing eyelets 20 and 21, respectively, at their ends. Mounted in the bearing eyelets 20 and 21 is a shaft 22 which extends horizontally over the base plate 1 and on which an angle lever 23 is fastened in a rotationally fixed manner, as is indicated at 24. The angle lever 23 is thus guided precisely in a radial plane in relation to the shaft 22.

A lever leg which is oriented vertically downwards in the position of FIG. 2 forms the abovementioned, longer link arm 6, and a lever leg which is oriented essentially perpendicularly thereto forms the abovementioned angle leg 12. FIG. 2 also shows those parts of the drive mechanism which have been described with reference to FIG. 1, namely the coupling rod 13 and the crank drive 14.

The bottom end of the link arm 6 is forked, in the manner which can be seen from FIG. 2, and articulated on the link hand 4 between the ends of the latter. An angled part 25 of the link hand 4 serves for the articulated connection of the link arm 7, which is shorter than the angle lever 6.

The top end of the link arm 7 is connected, via the abovementioned articulation 9, to a structural angle 27 which is fastened on the side bearing support 18. On account of the point of articulation 9 being offset laterally relative to the pivot direction of the link arms 6 and 7, and also on account of the lever 7 being articulated on the angled portion 25 of the link hand 4, the link arms 6 and 7 may be guided past one another, in order to realize a large pivot range.

Figure 3:
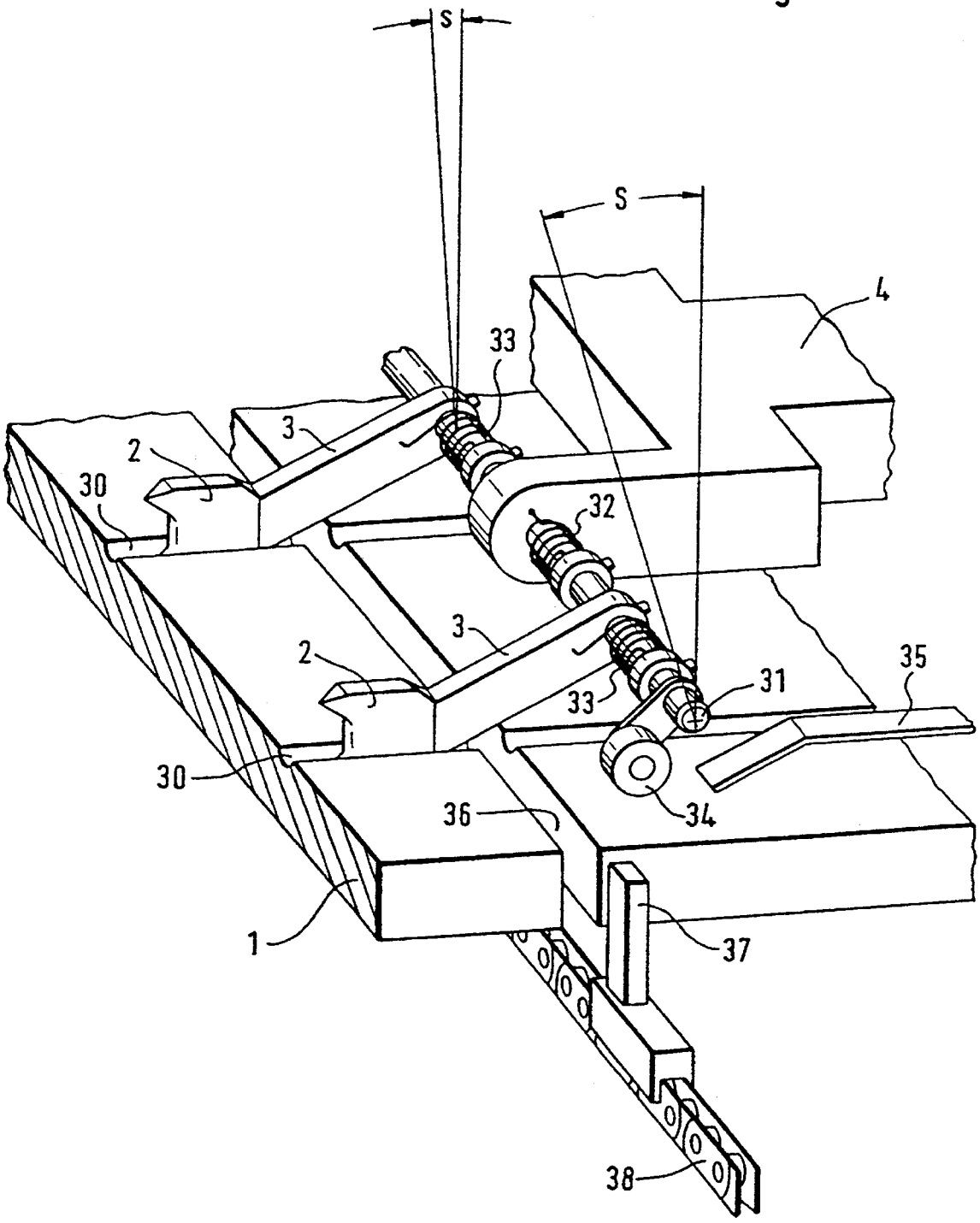
FIG. 3 shows a schematic, perspective view of part of the inserter according to FIG. 2 in modified form.

FIG. 3 shows that the base plate 1 may be provided with guide grooves 30 which extend over the surface of the base plate 1 in the direction of the operating stroke of the handling station or of the inserter. During the operating stroke, the push-in fingers 2 are displaced in said grooves 30 and are retained in the grooves 30 at their finger extensions 3 in that a common pivot shaft 31, to which the push-in fingers 2 are coupled via their finger extensions 3, is prestressed in the anticlockwise direction with respect to the link hand 4, which retains the pivot shaft 31, within a certain pivot region S. This can be effected by a helical spring 32, which is indicated for example at 32 in FIG. 3, wrapped around the pivot shaft 31 and is anchored, on the one hand, on an adjusting ring seated fixedly on the pivot shaft 31 and, on the other hand, at an anchorage point of the link hand 4. Details in this regard, however, may be modified in a manner which is familiar to the person skilled in the art.

The individual push-in fingers 2 and their finger extensions 3, however, are not coupled to the pivot shaft 31 in an absolutely rotationally fixed manner. Rather, coupling takes place with a small amount of rotary play s under spring loading by prestressing means in the form of helical springs 33, which wrap around the pivot shaft 31 and are anchored, on the one hand, on adjusting rings seated fixedly on the pivot shaft 31 and, on the other hand, at anchorage points of the finger extensions 3.

Arranged in an offset manner at that end of the pivot shaft 31 which is directed towards the person who is looking at the figure, or on one of the push-in-finger extensions 3, is a guide follower roller 34 which interacts with a raisable and lowerable control guide 35 such that, during the operating stroke, the push-in fingers 2 move in a state in which they have been lowered in the groove 30 of the base plate 1, while, during the return stroke, the guide follower roller 34, in conjunction with the control guide 35, causes the pivot shaft 31 to pivot in the clockwise direction, in relation to FIG. 3, and the push-in fingers 2, with their extensions 3, to pivot upwards in the clockwise direction. Details in this regard are also known per se to the person skilled in the art.

In the embodiment according to FIG. 3, the base plate 1 is subdivided by a slot 36 which extends transversely to the operating stroke of the handling station or the inserter and serves for the through-passage of conveying fingers 37 of a conveying chain 38 extending through beneath the base plate 1.

If it is the intention for certain inserts or articles which are to be handled not to be gripped by the push-in fingers 2 during an operating stroke of the apparatus shown in FIG. 3, then corresponding actuation of the control guide 35 ensures that the push-in fingers 2 remain raised off from the base plate 1 not just during the return stroke but during the operating stroke as well. The conveying chain 38 is then set in operation and the conveying fingers 37, which project up through the slot 36 beyond the level of the surface of the base plate 1, convey such left-behind inserts further in the conveying direction of the transporting chain 38, in order to feed them to other processing stations, for example other inserters, as is known for example from DE-A 195 00 746.

It has been found, then, in the case of handling stations or inserters of the type specified here that the push-in fingers 2 run reliably on the base plate 1 even when the base plate is interrupted by transverse slots such as the slot 36. There is no instance, in any operating phase, of the bottom nose of the push-in fingers 2, running in the groove 30, trying to raise off from the base plate 1 during the operating stroke and to lose the trailing edge of the article or insert which is to be conveyed.

It will be understood that various details of the invention may be changed without departing from the scope of the invention. Furthermore, the foregoing description is for the purpose of illustration only, and not for the purpose of limitation—the invention being defined by the claims.

What is claimed is:

1. A handling apparatus for moving sheet-like articles on a rectilinear, defined handling path, said handling apparatus comprising an inserter for pushing inserts into envelopes in an operating stroke in a handling direction, said inserter having a link arrangement which is framework-mounted above a horizontal base plate and which can be pivoted by a drive apparatus for producing pivot movements of the bottom part of the link arrangement in the direction of the handling path, and having, on the bottom part of the link arrangement, pivotable fingers which are prestressed downwards by spring means and of which the outer ends rest on the base plate during an operating stroke and, during the return stroke, are raised off together from the base by means of a control guide arrangement, wherein the link arrangement has two link arms which are framework-mounted above the base plate and are of different lengths, and a link hand which is connected to the bottom ends of the link arms via articulations and has the fingers articulated on its free section, which projects beyond its point of articulation for the longer of the two link arms, and in that the length of the longer link arm, of the shorter link arm and of the spacing between the articulations on the link hand are dimensioned such that the point of articulation of the fingers on the free section of the link hand is moved approximately horizontally over the base plate at least for a considerable part of the handling direction.

2. The handling apparatus according to claim 1, wherein the drive apparatus acts, via a drive linkage actuated by a crank, on an angle leg which projects at an angle from the top end of one of the link arms, in the vicinity of articulation.

3. The handling apparatus according to claim 1, wherein the fingers having groove-like paths on the base plate that intersect a transversely running slot in the base plate for the through-passage of conveying fingers of a conveying chain, extending through transversely beneath the base plate, for the articles which are to be conveyed.

4. The handling apparatus according to claim 1, wherein on that side of the handling apparatus which is opposite the side on which the fingers are located, a conveying belt or a conveying chain for articles to be conveyed having conveying fingers, extends up to the handling apparatus, said conveying belt or conveying chain having a feeding direction corresponding to the handling direction of the handling apparatus, the path of conveying fingers of said conveying belt or conveying chain extending, between the paths of the fingers of the handling apparatus in the initial section of the operating stroke of the link arrangement.

5. The handling apparatus according to claim 4, wherein the conveying speed of the conveying belt or of the conveying chain is coordinated with the speed of the link arrangement of the handling apparatus such that, in the initial section of the operating stroke, the fingers engage from behind with the trailing edge of the articles to be handled as such articles are pushed forwards by the conveying fingers of the conveying belt or conveying chain, and then advance forwards, overriding the conveying fingers of the conveying belt or conveying chain, said conveying fingers of the conveying belt or conveying chain, then being respectively lowered beneath the level of the base plate as the conveying belt or the conveying chain continues its operation.

6. The handling apparatus according to claim 4, wherein the conveying belt or the conveying chain can be driven continuously.

7. The handling apparatus according to claim 1, wherein the fingers are fastened on a common shaft with a small amount of rotary play, with loading by prestressing means between the finger and shaft, and wherein the shaft is retained in bearings of the link hand such that it can be rotated within a certain pivot region, said pivot region being subjected to loading by further stressing means between the shaft and the link hand.

* * * * *